United States Patent [19]

Hoppe

[11] 4,407,525

[45] Oct. 4, 1983

[54] IDENTIFICATION CARD WITH HALLMARK FOR AUTHENTICATION BY INCIDENT AND TRANSMITTED LIGHT

[75] Inventor: Joachim Hoppe, Munich, Fed. Rep. of Germany

[73] Assignee: GAO Gesellschaft fur Automation und Organisation mbH, Munich, Fed. Rep. of Germany

[21] Appl. No.: 263,373

[22] Filed: May 13, 1981

Related U.S. Application Data

[63] Continuation-in-part of Ser. No. 81,704, Oct. 4, 1979.

[51] Int. Cl.[3] ..... B42D 15/02; G09F 3/02

[52] U.S. Cl. ..... 283/110; 283/111

[58] Field of Search ..... 283/6, 7, 8; 40/2.2; 350/314

[56] References Cited

U.S. PATENT DOCUMENTS

| | | | |
|---|---|---|---|
| 2,110,500 | 3/1938 | Chiera | 350/314 X |
| 2,506,153 | 5/1950 | Hurley | 350/314 X |
| 3,414,998 | 12/1968 | Berger | 40/2.2 |
| 3,802,101 | 4/1974 | Scantlin | 40/2.2 |
| 3,897,964 | 8/1975 | Oka et al. | 283/7 |
| 3,930,924 | 1/1976 | Oka et al. | 283/7 X |
| 4,066,280 | 1/1978 | LaCapria | 283/8 R |
| 4,079,673 | 3/1978 | Bernstein | 283/8 R X |
| 4,124,947 | 11/1978 | Kuhn et al. | 283/8 R X |
| 4,307,899 | 12/1981 | Hoppe | 283/7 |

*Primary Examiner*—Paul A. Bell
*Assistant Examiner*—John S. Brown
*Attorney, Agent, or Firm*—Neuman, Williams, Anderson & Olson

[57] ABSTRACT

An identification card constructed of several film layers is provided with a monochrome or polychrome printed pattern. The printed pattern consists of partially overlapping color layers placed over each other and distributed over the surfaces of the film layers.

The resulting printed pattern exhibits shadow effects in incident light which are reversed in transmitted light. A certain spatial effect and definite half-tone grading of the printed pattern can be achieved by the number and arrangement of the various printed layers.

13 Claims, 5 Drawing Figures

Figure 1:
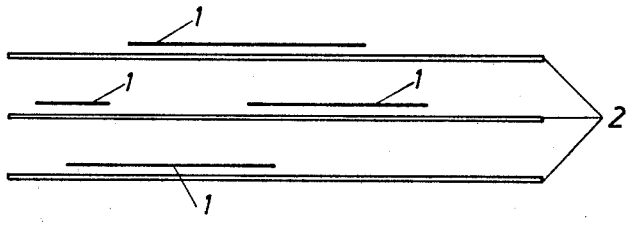

IDENTIFICATION CARD WITH HALLMARK FOR AUTHENTICATION BY INCIDENT AND TRANSMITTED LIGHT

This application comprises a continuation-in-part of my co-pending application Ser. No. 081,704, filed Oct. 4, 1979, the disclosure of which is incorporated herein by reference.

The subject matter of application Ser. No. 081,704 concerns an identification card with authenticity features or hallmarks which may be tested in incident and transmitted light. Such card includes a sheet-like base with several cover films if desired, which may be laminated to the base. The monochrome or monochromatically printed base is printed with colors over large areas and partly with areas at least partially overlapping with each other. The overlapping printed areas of the base provide a visual effect similar to that provided by a more expensively produced watermark. Thus, the overlapping color areas appear lighter in incident light reflected therefrom, and darker when viewed in transmitted light than the areas surrounding such overlapping areas.

Thus, the parent application discloses an identification card having features defining a hallmark that can be tested and authenticated in incident and transmitted light, whose manufacture requires a certain technical effort to manufacture, and a card which can consist entirely of plastic layers.

It is not necessary to arrange the printed areas on only one layer surface in the case of multilayer identification cards in order to attain the objectives of the parent application.

The objectives of the parent application can be obtained not only in the manner disclosed in the parent application Ser. No. 081,704 but also by placing the printed areas on several surfaces of the identification card layers (or foils) including its base.

In accordance with this invention the various printed areas defining a hallmark may be formed on the front side as well as on the reverse side of the various layers of an identification card.

In addition to the advantages stated in the parent application, the card embodiment of this invention has, among other things, the added beneficial feature that the printed color areas can be formed of different inks which are applied by different printing techniques. Because of the separated printings or color applications on the various layers, different inks may be employed in the same card even when the inks are not compatible with each other.

Furthermore, an additional spatial or three dimensional effect which extends the scope of card variations possible is obtained due to the possibility of placing various elements of the printed pattern defining a hallmark on different layer or foil levels of the identification card. In the card embodiment in which each card layer is only printed once, the carrier can be printed readily without deformation of the material. When several printed layers are applied successively to a carrier such as an overlying or substrate layer or foil, there may be strains generated which cause wavy deformation in the card foil during the ink drying process and complicate the further handling of the carrier layer in the subsequent lamination process. If one or more card layers are printed on the front and reverse sides simultaneously, this can be carried out without intermediate ink drying periods, and, if necessary, may be effected also on simultaneously operating printing machines.

Further embodiments and advantages of the invention can be inferred from the appended claims and the following description when read in the light of the accompanying drawing in which:

FIGS. 1–5 each show a graphic representation of an identification card or print carrier constructed of three layers and provided with different printed areas. To facilitate an understanding of the card construction, the layers, as well as the printed areas thereon, are shown in cross-section and separated from each other.

FIG. 1 shows an identification card or print carrier for which various printed areas 1 appear on the upper sides of single layers or foils 2. This type of arrangement of the printed areas leads to a spatial separation thereof, which results in an additional spatial effect when the printed patterns are appropriately designed and especially when thick layers 2 are used; also, half-tone visual impressions may be effected as described in my known parent application. The three-dimensional impression is heightened when the single layers 2 are also at least slightly inked, or coated homogeneously. This spatial effect can be additionally varied and emphasized by the use of foils of differing thickness and print layers of differing opacity, as the case may be.

Figure 2:
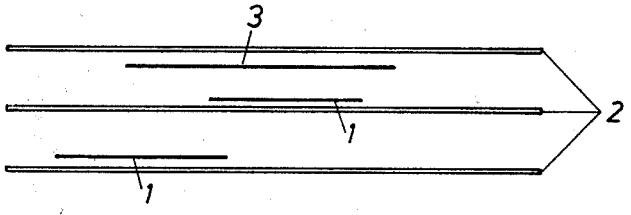
Figure 3:
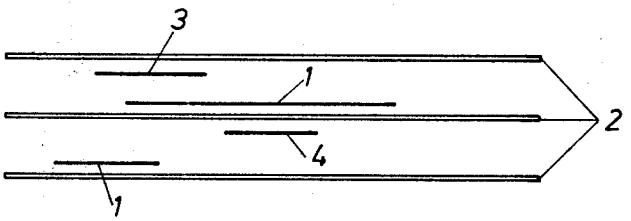

FIG. 2 shows an identification card layer construction in which a printed area 3 is arranged on the bottom side of upper single layer 2, along with printed color areas 1 on the upper side of underlying single layers 2. The two printed areas 1 and 3 on the front and reverse sides of the adjacent layers cannot be distinguished from layers printed directly over each other, when the card is laminated. This type of arrangement is especially appropriate in cases when it is not possible to print the various hallmark elements over each other due to the employment of different printing processes and/or incompatible inks, but the impression of a unitary printed pattern is to be maintained.

FIG. 3 shows again the layering of printed areas 3, 1 and 4, 1 on coincident levels. In this arrangement, middle layer or foil 2 is printed on the upper, as well as on the lower, side with printed patterns 1 and 4, respectively which can take place simultaneously in one printing operation without intermediate drying periods, if necessary.

Figure 4:
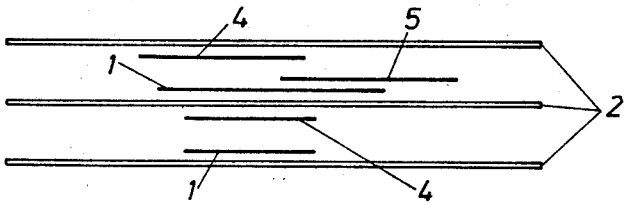

FIG. 4 shows a card layer construction in which printed areas 1 and 5 are printed on the middle layer upper surface in overlapping relationship in a manner disclosed in my parent application. The other printed or colored layers are distributed onto other surfaces of the single layers, as in the above examples. The lowest layer 2 has a printed pattern 1 congruent to the printed pattern 4 on the reverse side of the middle layer, which results in a color reinforcement of this printed area when looked at in transmitted light, without any variation of the inks or the printing thickness being necessary.

Figure 5:
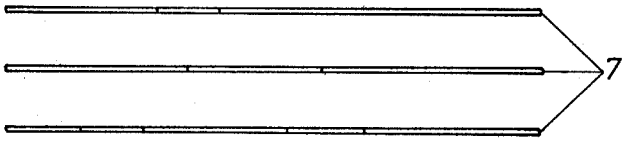

All the examples up to now have been directed to printing various print or color layers over each other. It is clear that the same or similar effects can be achieved by using homogeneously coated or inked single layers which initially completely cover the card layer surfaces to which applied and from which the color has been removed in the areas defining a transparent hallmark design. An equivalent transparent design can be effected most simply by punching out the light areas, as shown in FIG. 5.

In order not to disturb the even application of the laminating compound by the areas of differing thickness resulting from the punched out areas, relatively thin single layers 7, compared to the entire thickness of the identification card, should, however, chiefly be used in the punched-out consideration. Layers 7 may be supplemented as required by additional neutral filler layers with the necessary thickness to provide necessary card thickness.

It is believed apparent that the above-discussed examples comprise only a small selection of the host of possibilities of structural variations which may be made in accordance with the invention disclosed. The single layers or foils may comprise plastic films as well as paper layers. The steps necessary for the lamination of multilayer constructions are familiar to those skilled in this particular art. Furthermore, the number of single layers and printed layers for an identification card is not limited in any way by the disclosed arrangements. Any combination of single foil layers and color layers applied thereto may be employed to provide the desired visual effect.

Thus, the cover foils of the provided card construction can also be printed at the same time. Also, the color carrier can also be constructed of a single layer with opposed color applications on the opposed layer sides to provide a hallmark providing a desired visual effect.

I claim:

1. In an identification card adapted to be authenticated by transmitted and reflected light comprising at least one substrate layer of substantially homogeneous color or having a substantially uniform color layer thereon; said card also having partially overlapping layers of colors comprising complementary design portions providing desired visual effects whereby light transmitted through the overlapping areas of the color layers is less than the light transmitted through the nonoverlapping areas so that the overlapping areas appear darker to the eye than the nonoverlapping areas when light is transmitted therethrough, and whereby light reflected from the overlapping areas visually possesses greater color intensity than the surrounding, the improvement comprising forming the layers of colors on at least two discrete substrate layer surfaces of said card whereby said complementary design portions are disposed in spaced planes.

2. An identification card adapted to be authenticated by transmitted and reflected light comprising at least one card substrate layer having opposed surfaces; said card also having partially overlapping layers of colors; said at least one substrate layer and said color layers being light-pervious; said substrate layer also being of substantially uniform color throughout or having a Uniform color layer printed thereon; the overlapping areas of said color layers comprising complementary design portions providing desired visual effects in transmitted and reflected light; said design portions defining a hallmark whereby light transmitted through the overlapping areas of said color layers is less than the light transmitted through the nonoverlapping areas so that the overlapping areas appear darker to the eye than the nonoverlapping areas when light is transmitted therethrough, and whereby light reflected from the overlapping areas of said color layers visually imparts greater color intensity than the surrounding; said color layers being disposed on at least two discrete substrate layer surfaces of said card.

3. The identification card of claim 1 or 2 wherein the color layers are disposed on surfaces of at least two substrate layers.

4. The identification card of claim 1 or 2 wherein the various color layers are distributed over the opposed surfaces of the card substrate layers.

5. The identification card of claim 1 or 2 wherein the color layers are only on one surface of each card substrate layer.

6. The identification card of claim 1 or 2 wherein the card substrate layers are coated or inked over their entire surfaces and have complementary openings punched therefrom.

7. The identification card of claim 1 or 2 wherein the card layers have differing thicknesses.

8. The identification card of claim 6 wherein an intermediate filler card layer is placed between adjacent, punched, card layers.

9. The identification card of claim 1 or 2 in which said colored layers comprise complementary printed material defining a hallmark having reverse light intensities in transmitted and reflected light.

10. An identification card adapted to be authenticated by transmitted and reflected light comprising at least two separate substrate layers; each of said card layers having design means which partially overlaps and complements the design means in the other card layer or layers, whereby light transmitted through the overlapping areas of said design means is of an intensity different from the light intensity transmitted through the nonoverlapping areas of said design means; said overlapping design means defining a single authenticating design providing different visual effects when viewed in light transmitted through the overlapping areas and in light reflected from the overlapping areas.

11. The card of claim 10 in which said design means comprise color layers disposed on portions of spaced surfaces of said card layers and which appear darker where overlapping than the surrounding when viewed in transmitted light, and which appear lighter than the surrounding when viewed in reflected light.

12. The card of claim 10 in which said design means comprise voids extending through the thicknesses of the layers in which disposed and which appear lighter where overlapping than the surrounding when viewed in transmitted light and which appear darker than the surrounding when viewed in reflected light.

13. The card of claim 10 in which said design means comprise transparent uncolored surface portions of card layers surrounded by colored surface portions of said card layers which uncolored portions appear brighter where overlapping than the surrounding colored portions when viewed in transmitted light, and which uncolored portions appear darker than the surrounding portions when viewed in reflected light.

* * * * *